US006658232B1

(12) United States Patent
Johnson

(10) Patent No.: US 6,658,232 B1
(45) Date of Patent: Dec. 2, 2003

(54) METHOD AND SYSTEM FOR TRANSMITTING AUDIO DATA TOGETHER WITH OTHER DATA, COMPRISING ADDRESSING DATA, TO A RECEIVER

(75) Inventor: Nicholas Dougall Johnson, Hertfordshire (GB)

(73) Assignee: TTPCom Limited, Royston (GB)

( * ) Notice: Subject to any disclaimer, the term of this patent is extended or adjusted under 35 U.S.C. 154(b) by 0 days.

(21) Appl. No.: 09/601,720

(22) PCT Filed: Feb. 18, 1999

(86) PCT No.: PCT/GB99/00514

§ 371 (c)(1),
(2), (4) Date: Aug. 4, 2000

(87) PCT Pub. No.: WO99/43109

PCT Pub. Date: Aug. 26, 1999

(30) Foreign Application Priority Data

Feb. 20, 1998 (GB) ..... 9803623

(51) Int. Cl.[7] ..... H04H 1/00

(52) U.S. Cl. ..... 455/3.06; 455/3.02; 455/426; 379/102.03; 379/406.3

(58) Field of Search ..... 455/426, 414, 455/456, 460, 9, 563, 3.02, 45, 3.01, 3.03, 3.06, 39; 704/200, 206, 270, 275, 102.02; 379/93.18, 93.34, 406.03, 102.03

(56) References Cited

U.S. PATENT DOCUMENTS 5,499,288 A * 3/1996 Hunt et al. ..... 379/88.02
5,584,051 A * 12/1996 Goken ..... 455/68
5,777,571 A * 7/1998 Chuang ..... 341/176
5,806,040 A * 9/1998 Vensko ..... 704/273
5,812,937 A * 9/1998 Takahisa et al. ..... 455/66.1
5,907,793 A * 5/1999 Reams ..... 725/122
5,978,689 A * 11/1999 Tuoriniemi et al. ..... 455/569
6,067,516 A * 5/2000 Levay et al. ..... 704/244

FOREIGN PATENT DOCUMENTS

WO WO 77751 A1 * 12/2000 ..... G07F/7/10

* cited by examiner

*Primary Examiner*—William Trost
*Assistant Examiner*—Congvan Tran
(74) *Attorney, Agent, or Firm*—Andrus, Sceales, Starke & Sawall, LLP

(57) ABSTRACT

The present invention concerns a method for transmitting audio information to a receiver, in which first audio information is transmitted from a first source to the receivertogether with other information comprising addressing data and a data signal dependent on the addressing data is selectively transmitted from the receiver to a service provider. The data signal received at the service provider is matched with respective further audio information and the respective further audio information is then transmitted from a second source to the receiver. Thus, a web of recursively linked audio material may selectively be provided to a user of the receiver.

46 Claims, 4 Drawing Sheets

METHOD AND SYSTEM FOR TRANSMITTING AUDIO DATA TOGETHER WITH OTHER DATA, COMPRISING ADDRESSING DATA, TO A RECEIVER

CROSS REFERENCE TO RELATED APPLICATION

The present application is the U.S. national stage application of International Application PCT/GB99/00514, filed Feb. 18, 1999, which international application was published on Aug. 26, 1999 as International Publication WO 99/43109. The International Application claims priority of Great Britain Patent Application 9803623.9, filed Feb. 20, 1998.

BACKGROUND OF THE INVENTION

The present invention relates to the transmission of audio information and to both a method and system for such transmission.

It is known to broadcast data along with audio signals in order to provide interruption of the broadcast audio signal by causing the receiver to retune automatically to a different frequency to receive alternative information such as news or traffic information. The Radio Data System (RDS) has been used for such purpose in Europe for several years. However, although the user is able to select for interruption between certain general types or categories of information, once this selection has been made by the user, the timing of interruption and the information provided are automatically determined by the service providing the information and to which the radio retunes. Whilst such a service is very valuable, it is limited in nature.

It is known eg from GB-A-2 313 981, EP-A-0 804 012 and WO-A-95-12929 to utilise a GSM or similar cellular radio link to instruct the playing of selected music, video or multi-media material from a remote source to the user via, for example a DAB or other broadcast signal. In order to provide a wider range of information to a radio user, a different system is necessary.

SUMMARY OF THE INVENTION

According to the present invention there is provided a method for transmitting audio information to a receiver, comprising: transmitting from a first source to the receiver first audio information together with other information comprising addressing data; selectively transmitting from the receiver to a service provider a data signal dependent on the addressing data; matching the data signal received at the service provider with respective further audio information; transmitting the respective further audio information from a second source to the receiver.

The invention also includes a system for transmitting audio information to a receiver, comprising:

- a first source for transmitting to the receiver first audio information together with other information comprising addressing data;
- means at the receiver for converting the first audio information to an audio signal;
- means at the receiver selectively operable for transmitting to a service provider a data signal dependent on the addressing data;
- comparing means for matching the data signal received at the service provider with respective further audio information;

- a second source for transmitting the respective further audio information from the service provider to the receiver; and,
- means at the receiver for converting the further audio information to an audio signal.

By this method and system a web of recursively linked audio material may selectively be provided to a user of the receiver through the use of appropriate keys at the receiver. The system may be operated by the user to provide further audio information related to the first audio information by extracting the addressing data and transmitting a corresponding data signal, via say a digital mobile telephone network, to a service provider system at which the received addressing data is matched, using a database, with further audio information related to the first audio information, and that further audio information is then transmitted to the receiver. A further key may be used to return the listener to the original audio information transmission or to the previous one.

The system of the invention may use a conventional RDS system to provide the transmission of the further audio information, by causing a transmitter (source) related to the first transmitter (source) to interrupt the reception of the first audio information with the further audio information, but preferably, the system makes use of digital audio broadcasting (DAB) signals to provide the first audio information signal and related addressing data and the further audio information and further addressing data are transmitted by a DAB transmitter related to the transmitter providing the first audio information and addressing data, or else by the mobile telephone link used to transmit the addressing data-related signal to the service provider.

However, the invention is not limited to particular mechanisms or types of transmission of either the audio information and related addressing data nor of the addressing data-related data signal and these could be provided by wireless, wire or cable links. For example the original transmission could be an audio information signal (together with related addressing data) transmitted by an Internet web site.

In order to indicate to a user that there is further audio information related to the first (or subsequent) audio information provided to the user, the audio signal is augmented. This may be achieved in a number of ways and the augmentation may, depending on the method chosen, occur either at the source (ie. to the transmitted audio information) or else at the receiver (ie. to the received audio information before conversion). For example a beep may be inserted at the beginning and end of sections of audio information transmission to indicate to a listener that what follows is capable of being linked to to provide further information. Alternatively, audio processing may be used to give the converted audio signal a particular auditory shade or style. A further possibility is to provide a visual indication on a visual display panel associated with the receiver.

When the user has selected or linked to further audio information, the converted audio signal needs to be separated from the original audio signal to indicate that the listener is now linked to additional material. This may be done in a number of ways. For example, the transmission of audio information may be paused momentarily to indicate the change of content. Alternatively, the audio signals may be superimposed, with the further audio information being more prominent than the original. A still further possibility is to separate the original and further audio signals to left and right stereo channels, with suitable mixing down of the original signal from stereo to mono if necessary. The various type of separation may be selected by the user and they may be combined if desired, the required circuitry for the different types being provided within the receiver.

BRIEF DESCRIPTION OF THE DRAWING

Three examples of a system according to the present invention will now be described with reference to the accompanying drawings, in which.

DETAILED DESCRIPTION OF THE INVENTION

Figure 1:
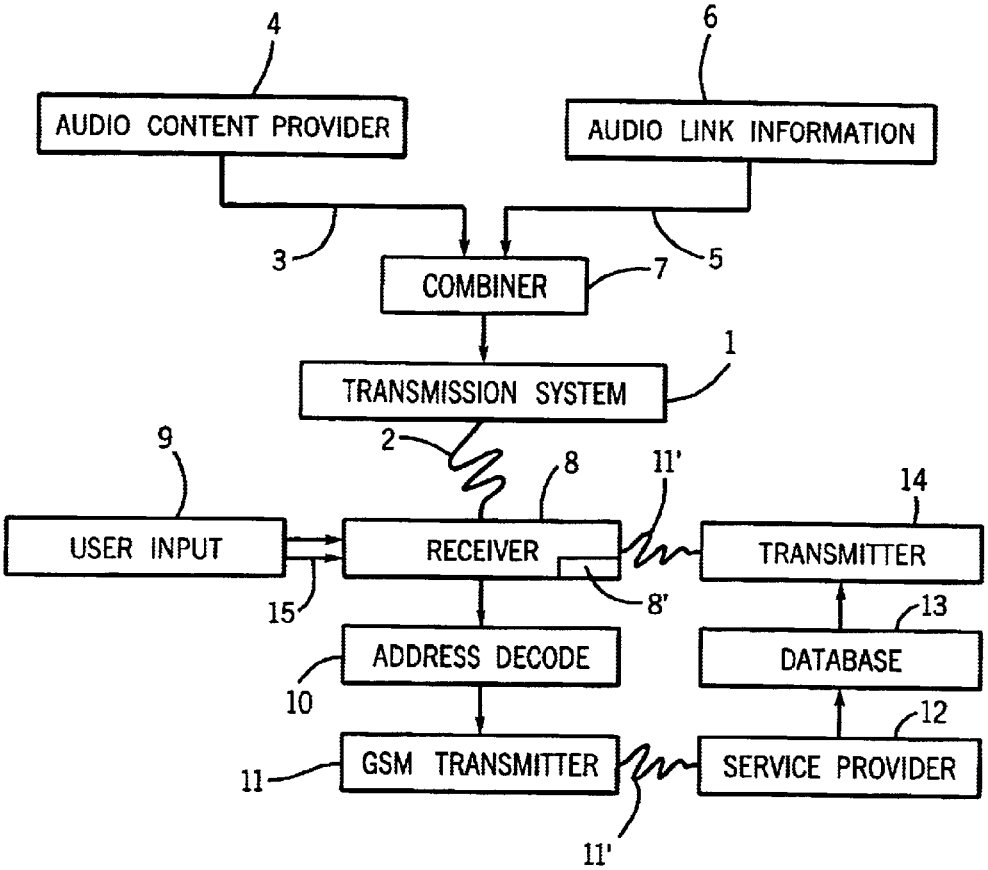
FIG. 1 is a block diagram of the components of a generalised system.

The example illustrated in connection with the accompanying FIGS. 1 and 2 utilises a DAB receiver which incorporates a GSM mobile telephone.

A DAB transmission system 1 provides an audio information broadcast 2, the broadcast 2 comprising both audio information 3 provided from an audio content provider 4 and addressing data 5 provided by an audio link information system 6. The audio information and the addressing data are combined at 7 and fed to the DAB transmission system 1. As is well known, a DAB transmission incorporates a PAD channel and it is the PAD channel which carries the audio link information or addressing data 5.

At a receiver 8 a listener or user is able to activate a key 9 (known as the "Tell Me More" [TMM] key) which causes the addressing information received on the PAD channel to be decoded by a decoder 10 and passed to the GSM telephone 11 which, using the decoded addressing data dials, an appropriate number to a service provider 12. The service provider maintains a database of audio "clips" 13, each one corresponding to corresponding addressing data 5. On receiving the transmission from the GSM transmitter 11 the database is scanned for a match and the corresponding audio clip is transferred from the database to a transmitter 14 which transmits information to the receiver 8. The transmitter 14 may be a separate DAB transmitter or the like, but in the present example it is preferably a GSM transmitter and the information is transmitted back to the receiver through the same call initiated by the user.

The use of the system will now be described in more detail by reference to the table of FIG. 2.

Figure 2:
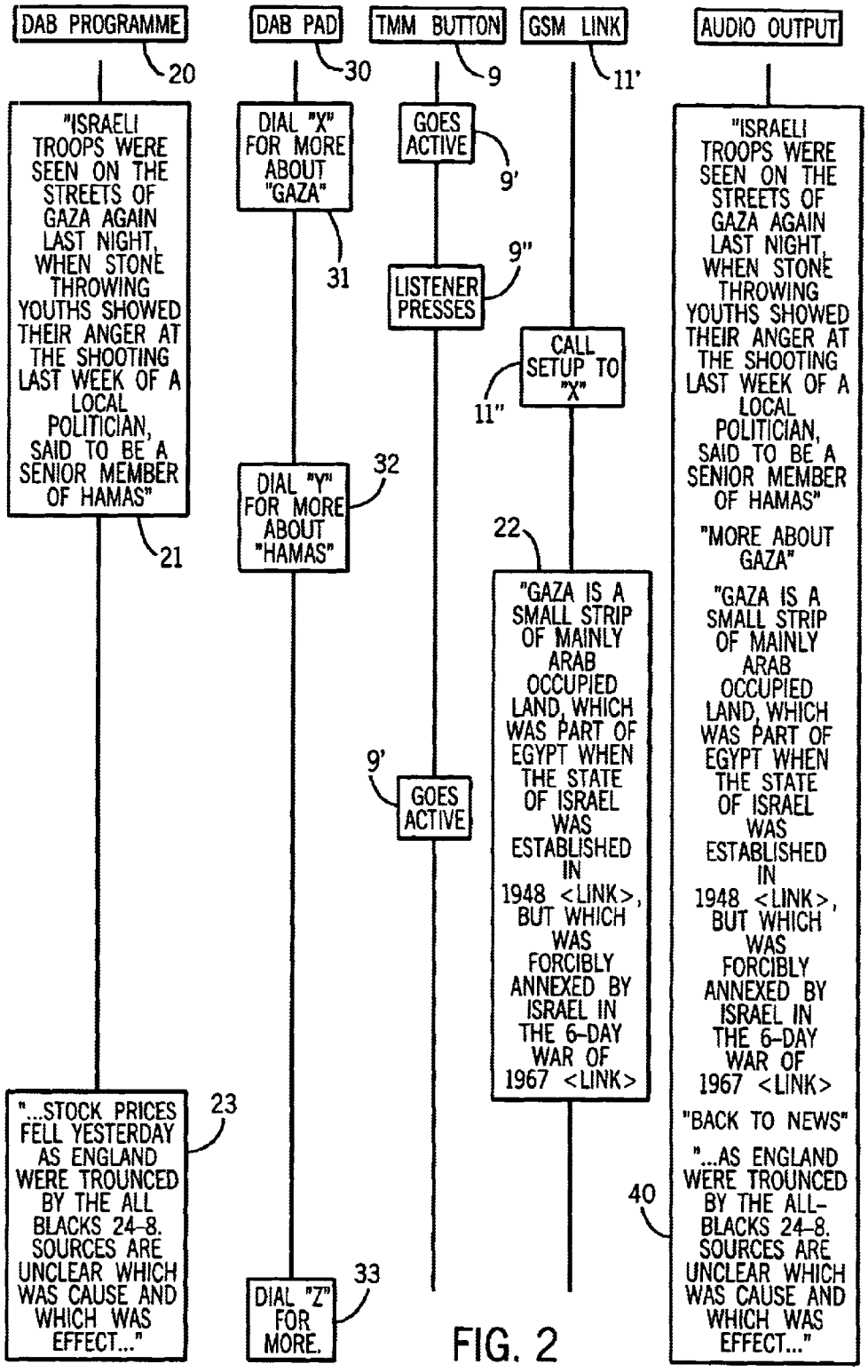
FIG. 2 is a table showing links between related audio information which might be provided by the system.

The example shown in the table of FIG. 2 comprises a DAB programme 20 which carries a news item, in the example, describing an (imaginary) incident in the Gaza Strip, a portion of the text of which is shown at 21. The DAB PAD channel 30 contains addressing or link information which enables the user to find out more information about the Gaza Strip and on receipt of the PAD channel information at a receiver display 8' (see FIG. 1) displays the text shown at 31, inviting the listener or user to dial (a given telephone number?) on the GSM telephone 11 to find out more information. In order to avoid the listener having to actually dial the telephone number himself, the addressing data transmitted by the DAB PAD channel is decoded within the decoder 10 and the "Tell Me More button" 9 is effectively "enabled" at 9' so that if the user wishes to obtain further information all he has to do is then press (9") the TMM button.

Operation of the TMM button causes the GSM telephone 11 to establish a GSM link 11' which (11") sets up a call to the service provider 12 as described above. Addressing data within the DAB PAD channel, decoded and transmitted through the GSM link 11', is read at the service provider 12 and matched within the database 13. The corresponding further audio information or "clip" is transmitted by the transmitter 14 using the same GSM call to provide further audio information back to the listener, for example the text shown at 22. The signal transmitted back to the user and containing the audio information 22 may itself contain further links, for example, as illustrated, for further material about the state of Israel and the 6-Day war of 1967 and these are also decoded in the decoder 10 and may be used by the system and through operation of the TMM button 9, to find out further audio information from the service provider 12 or from a separate service provider if the information is held in a different database for example.

The righthand side of the table of FIG. 2 illustrates the audio output to the user in the textbox 40. It can be seen that at the start of the link information there is a "header" to advise the user that more information is being provided about the chosen subject (in this case the Gaza Strip) and at the end a "footer" is provided indicating that the audio output is returning to the DAB programme material.

The first news item 21 may contain a second or further link, for example, allowing the user to operate the TMM button 9 to find out more information about the "Hammas" organisation. Again the display 8' displays relevant text 32 to the user. The listener may choose not to find out more information about the Gaza Strip, but may decide to find out more about Hammas instead.

A second news item 23 may contain its own separate links allowing the user to link to further material held on the service provider database 13 or on the database of a separate service provider.

As described in the introduction to the specification, the presence of addressing data (which defines the presence of a link) may be highlighted in the audio stream to the user by a beep or similar and/or by text signalling in the DAB PAD channel and displayed on the display 8' of the receiver 8.

The linked-to material (LTM) is separated from the basic audio programme content 21 or linked-from material (LFM) so that the listener understands where the LTM starts and finishes. This may be achieved by simple replacement after a pause, a similar pause being provided at the end of the LTM, or by superposition, the LFM being mixed down and the LTM added to the audio stream so that the listener hears the LFM and LTM together, with the LTM being more prominent. The listener can still "tune-in" to the LFM if desired and also unconciously uses it as a indicator of the linked material. A third alternative is stereo separation in which case the LFM (which may already be in stereo) is mixed down to mono if necessary and placed in one direction to say the left stereo channel and the LTM (which owing to GSM bandwidth limits will almost certainly be in mono) is placed in a different direction to say the right stereo channel.

All the processing necessary to implement the different styles of presentation of the LTM can be contained within the receiver 8 and may be selectable by the listener as a personal preference or on an instance-by-instance basis.

The apparatus of the example of FIG. 1 also includes a "back" button 15 on the receiver 8, operation of which by the user can be arranged to cause the listener to be returned to the LFM.

Figure 3:
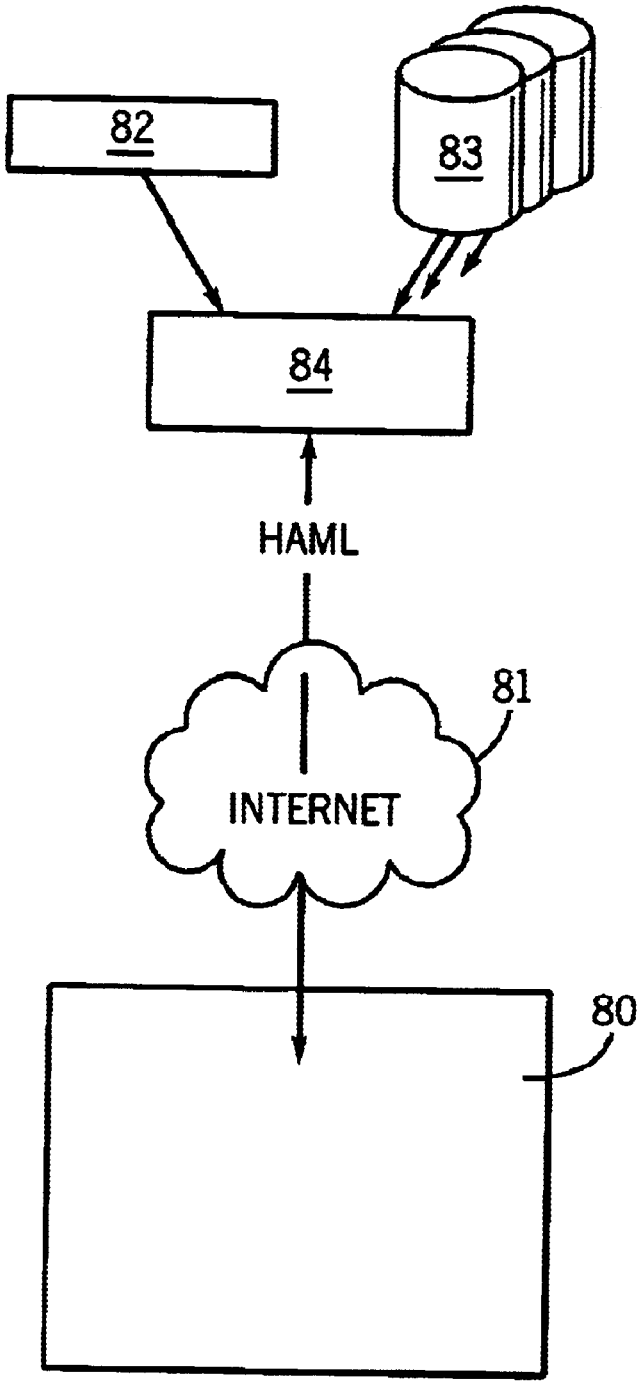
FIG. 3 illustrates the components of a second system.

The system illustrated in FIG. 3 utilises a multimedia computer 80 as a receiver and an Internet connection 81 as a transport medium for passing transmitted data to and from the multimedia computer from and to audio information sources 82,83 via a server 84.

The system makes use of a mark-up language which is capable of catering for audio links—HAML. The current generation of mark-up languages (including HTML, HDML, TTML, etc.) although multimedia in scope are not symmetrical in the way they treat their media. They all treat text and graphical information differently to audio, in that a user can link from textual and graphical contexts into further web pages, but audio may only be listened to, ie is strictly one-way. The idea of an audio link is not catered for in these prior mark-up languages.

A mark-up language for audio has special constraints within which it must work. In particular, audio is non-persistent—a spoken prompt will usually be replaced quickly with following material;

time-critical—responses to prompts must be registered and acted upon quickly;

one-dimensional—audio material is heard in time, not seen on a page.

Furthermore, in terms of navigation, the normal mouse driven paradigm is no longer necessarily valid. Typical terminal equipment may only have two keys for navigation—corresponding to "Follow" and "Back", and a very limited visual display. Also, the underlying transport will not necessarily by TCP/IP. The DAB MOT protocol, GSM, SMS, GPRS or circuit-switched data, and DTMF signalling over a fixed or mobile telephone link are all possible media, either separately or in combination. Also, the link may not be full-duplex, especially in broadcast contexts.

In practical terms this means that features must be present in the language to latch link data and announce the link in a way that a listener may respond to at a later time if necessary.

to announce to a server the form in which it should expect navigation commands.

The paucity of data link capacity also means that the traditional client-server model will be slightly modified. In fixed audio only link, it may be the case that the client runs within the network, and simply uses the link to the terminal for access to MMI events.

In the context of the system illustrated in FIG. 3, the overall arrangement is substantially similar to a conventional Word Wide Web (WWW) situation, except that the client (receiver) and server use HAML rather than HTML to communicate. The actual transport mechanism may be conventional HTTP since the link between them is a conventional internet connection of medium to high bandwidth, but could be any file or stream transport protocol (eg. FTP, RealAudio etc.)

An HAML script is transferred from the server 84 to the client 80 and are executed in the client, just as HTML scripts are executed. Navigation is performed on the client machine which sends GET requests to the server (in HTTP anyway) for new content.

A simple HAML page might look like:

EXAMPLE 1

```
<HAML VERSION=0.1 TIME=START_RELATIVE
  UNITS=MS LINKSTYLE=INTERRUPT>
<PLAY SOURCE=LadyOfShallot.wav>
<LINK_DESTINATION=http://www.ttpcom.com/tmm/
  camelot.haml
  CON=castle.bmp
  START=57803
  DURATION=5000>
<LINK DEFAULT DESTINATION=
  d:\authors\tennyson.haml
  CON=d:\authors\tennyson.bmp>
</PLAY>
</HAML>
```

The function of this example is to play the file "Ladyofshallot.wav" to the default output device (which is set by the interpreter of the file, not by the file itself). For most of the duration of the clip, the FORWARD button is labelled with the file d:\authors\tennyson.bmp. if the listener selects FORWARD, then interpretation jumps to the locally stored file d: \authors \tennyson.haml. For the 5s after 57.803s from the beginning of the clip, the bitmap castle bmp is used to label the FORWARD button. If the listener presses FORWARD during that time, then the internet is used to access the file /tmm/camelot.haml on the machine www.ttpcom.com, and that file is interpreted. When interpretation of either of the linked-to files ceases, then the original clip (LadyOfShallot.wav) plays again from the point at which it the link was taken.

The keywords in order, effect a behaviour as follows:

<HAML introduces the file and tells the interpreter it is HAML.

VERSION version information for the interpreter.

TIME=START RELATIVE all times in the file are to be measured relative to the start of the clip.

UNITS=MS the units of time are milliseconds.

LINKSTYLE=INTERRUPT if a link is taken, it interrupts the current audio.

<PLAY introduces the main audio stream.

SOURCE= . . . use this file as the source for the main audio stream.

<LINK introduces link information.

DESTINATION= . . . points to an HAML file—interpretation passes to this file if FORWARD is pressed.

ICON= . . . display the named graphics file behind the FORWARD button.

START= . . . the start time when the link becomes active (units and meaning defined by the TIME and UNITS parameters to the <HAML statement.

DURATION= . . . the length of time for which the link is active (again units and meaning defined by the <HAML statement parameters).

<LINK DEFAULT introduces information for the default link. This link is used when no other link is active. Note this statement has no START or DURATION parameters.

<IPLAY> tells the interpreter that the information for this particular audio stream is complete. When it reaches this it can begin playing the clip defined in the <PLAY statement.

</HAML> end of page

This example is suitable for a multimedia, internet-linked computer, where all the audio sources, links, icons, etc., are known beforehand.

Figure 4:
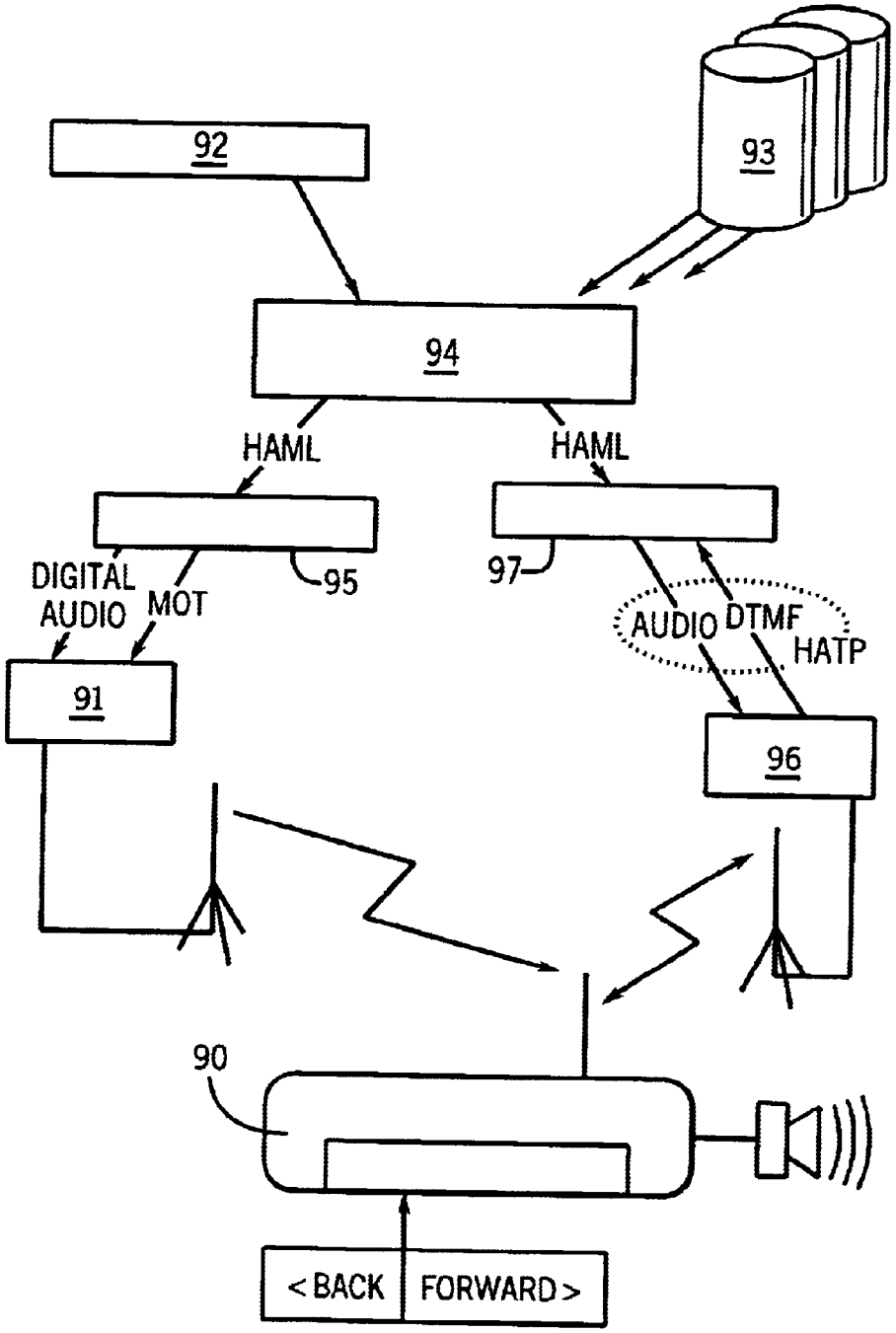
FIG. 4 illustrates the components of a third system.

FIG. 4 illustrates a system using a convergent broadcast/telephony system employing an integrated DAB and GSM system. Again the system employs an HAML server 94 which receives audio information from sources 92,93. The receiver in this case comprises an integrated DAB/GSM terminal 90 which receives an initial stream of audio information form a broadcast DAB network 91 which, in turn communicates with the server 94 via an HAMUMOT gateway 95. The DAB/GSM terminal 90 communicates with a GSM cellular network 96 which also communicates with the server 94 via an HAML proxy client 97.

In operation, the HAML server 94 sends HAML scripts along with audio information down the DAB network link to the terminal 90. In this case, the transport protocol will preferably be the ETSI specified MOT protocol (ETS 301 234). The HAML scripts are executed in the HAML client sitting in the terminal 90. The HAML specification defines that new content is addressed by a similar addressing scheme to HTML, ie a protocol specifier followed by a unique address such as:

http://www.ttpcom.com:8080/index.html.

In HAML the addressing scheme is very similar, for example:

hatp://www.ttpcom.com:+441763266266/index.haml

The hatp: part tells the client in the terminal 90 to invoke the Hyper Audio Transport Protocol handler (HATP) which then uses the number after the colon as a telephone number, by means of which access to the file index.haml on the machine www.ttpcom.com can be achieved. Note that the actual protocol is HATP as distinct from the language which is HAML.

Because the telephonic link is primarily audio (together with low bandwidth signalling like DTMF, GSM-SMS or similar), the file is not sent across the link, but rather is executed in the proxy client 97. This plays the audio information to the terminal across the telephonic link and indicates by means of a low bandwidth signal when the 'Tell Me More' button has become active and also, desirably, what text to use as a prompt on the terminals screen. The terminal client 90 sends a signal to the proxy client 97 indicating key presses ('Tell Me More' or 'Back') made by the listener as they happen. The proxy client 97 can then act on the requests, by accessing the new content or returning to the old content appropriately.

Preferably, congestion management strategies are provided in the design of the HATP/HAML server 94 so that, if a large number of users are calling the same address, then rather than opening a full GSM voice channel to each, the listeners are returned a DAB sub-channel designator and encryption key by means of which their DAB receivers can be automatically retuned for receipt of the requested content over the DAB channel in a broadcast manner. The requests can be logged for billing purposes and encryption ensures that only listeners who have paid for the content can decode it.

A further example illustrates the use of HATP/HAML:

EXAMPLE 2

```
<HAML VERSION=0.1 TIME=ABSOLUTE
  LINKSTYLE=CONCURRENT MIX=VOLUME>
<PLAY SOURCE=DAB>
<LINK PROXY
  DESTINATION=dialto:+441763262626:Camelot
  ICON=MOT Cameloticon
  START=Cameloticon. TriggerTime
  END=Camelotlcon.ExpireTime>
<LINK DEFAULT DESTINATION=smsto:+
  441763261582:Tennyson
  ICON=MOT:Tennysonicon>
</PLAY>
</HAML>
```

The function of the new statements is as follows:

TIME=ABSOLUTE all times in the file are absolute UTC.

LINKSTYLE=CONCURRENT if a link is taken, it overlays the current audio in a style defined by the MIX parameter.

MIX=VOLUME requests that the linked-to material is mixed in with the linked-from audio stream, at a slightly higher volume to achieve separation.

SOURCE=DAB the source of the main audio is the DAB station the listener is tuned to.

<LINK PROXY introduces a special kind of link. This says that the DESTINATION field points via a voice link to a proxy client, and that all navigation commands should therefore be sent as DTMF tones over that voice link.

DESTINATION= . . . In this case, the parameter value is a phone number, followed by a string. When the link is established, DTMF is used to signal the link reference (Camelot) to the server.

ICON= . . . the ICON is an MOT object, with the START and END times referenced from this.

START= . . . the start time when the link becomes active. Note that this syntax uses the TriggerTime field of the MOT object.

DESTINATION=smsto: . . . This is part of a standard link, but the sms to: prefix tells the interpreter to send a GSM short message with the designed text ("Tennyson") to the designated number.

What is claimed is:

1. A method for transmitting audio information to a receiver, comprising:

electronically transmitting from a first source to the receiver first audio information together with other information comprising addressing data;

converting the first audio information to an audio signal at the receiver;

selectively transmitting from the receiver to a service provider a data signal dependent on the addressing data;

matching the data signal received at the service provider with respective further audio information;

transmitting the respective further audio information from a second source to the receiver; and converting the further audio information to an audio signal at the receiver.

2. A method according to claim 1, wherein further addressing information is transmitted from the second source to the receiver with the further audio information;

selectively transmitting to the or another service provider a further data signal dependent on the further addressing data;

matching the data signal received at the or another service provider with respective still further audio information;

transmitting the respective still further audio information from the second or a further source to the receiver; and converting the still further audio information to an audio signal at the receiver.

3. A method according to claim 1, wherein the first audio information together with other information comprising addressing data is transmitted from the first source to the receiver by a wire-less broadcast signal.

4. A method according to claim 3, wherein the broadcast signal is a digital audio broadcasting (DAB) signal.

5. A method according to claim 3, wherein the broadcast signal is a radio data service (RDS) signal.

6. A method according to claim 1, wherein the first audio information together with other information comprising addressing data is transmitted from the first source to the receiver by a cable or wire connection between the first source and the receiver.

7. A method according to claim 6, wherein the first audio information together with other information comprising addressing data is transmitted via an Internet connection.

8. A method according to claim 1 or 2, wherein the data signal dependent on the addressing data is transmitted from the receiver to the or another service provider by a mobile telephone connection.

9. A method according to claim 8, wherein the mobile telephone connection is a GSM or CDMA connection.

10. A method according to claim 1 or 2, wherein the data signal dependent on the addressing data is transmitted from the receiver to the or another service provider by a cable or wire connection between the receiver and the or another service provider.

11. A method according to claim 1 or 2, wherein the data signal dependent on the addressing data is transmitted from the receiver to the or another service provider by an Internet connection between the receiver and the or another service provider.

12. A method according to claim 1 or 2, wherein the data signal received at the or another service provider is matched with the respective further audio information utilising a database of audio information.

13. A method according to claim 1 or 2, wherein the respective further audio information is transmitted from the second or further source to the receiver by a mobile telephone connection.

14. A method according to claim 13, wherein the respective further audio information is transmitted from the second or further source to the receiver by a GSM or CDMA connection.

15. A method according to claim 1 or 2, wherein the respective further audio information is transmitted from the second or further source to the receiver by a cable or wire connection between the second or further source and the receiver.

16. A method according to claim 1 or 2, wherein the respective further audio information is transmitted from the second or further source to the receiver by an Internet connection between the second or further source and the receiver.

17. A system for transmitting audio information to a receiver, comprising:

a first source for transmitting to the receiver first audio information together with other information comprising addressing data;

means at the receiver for converting the first audio information to an audio signal;

means at the receiver selectively operable for transmitting to a service provider a data signal dependent on the addressing data;

comparing means for matching the data signal received at the service provider with respective further audio information;

a second source for transmitting the respective further audio information from the service provider to the receiver; and, means at the receiver for converting the further audio information to an audio signal.

18. A system according to claim 17, wherein said second source transmits further addressing information to the receiver with the further audio information;

the receiver having means selectively operable to transmit to the or another service provider a further data signal dependent on the further addressing data;

a comparing means matching the further data signal received at the or another service provider with respective still further audio information; and, means at the second or a further source for transmitting the respective still further audio information to the receiver for conversion to an audio signal.

19. A system according to claim 17, wherein the first audio information together with other information comprising addressing data is transmitted from the first source to the receiver by a wire-less broadcast signal.

20. A system according to claim 19, wherein the broadcast signal is a digital audio broadcasting (DAB) signal.

21. A system according to claim 19, wherein the broadcast signal is a radio data service (RDS) signal.

22. A system according to claim 17, wherein the first audio information together with other information comprising addressing data is transmitted from the first source to the receiver by a cable or wire connection between the first source and the receiver.

23. A system according to claim 22, wherein the first audio information together with other information comprising addressing data is transmitted via an Internet connection.

24. A system according to claim 17 or 18, wherein the receiver includes a mobile telephone and the data signal dependent on the addressing data is transmitted from the receiver to the or another service provider by a mobile telephone connection.

25. A system according to claim 24, wherein the mobile telephone is a GSM or CDMA telephone.

26. A system according to claim 17 or 18, wherein the data signal dependent on the addressing data is transmitted from the receiver to the or another service provider by a cable or wire connection between the receiver and the or another service provider respectively.

27. A system according to claim 26, wherein the receiver includes a wire or cable-connected telephone.

28. A system according to claim 17 or 18, wherein the data signal dependent on the addressing data is transmitted from the receiver to the or another service provider by an Internet connection between the receiver and the or another service provider.

29. A system according to claim 17 or 18, further comprising a database of audio information connected to the second or further source, whereby the data signal received at the or another service provider is matched with the respective further audio information respectively.

30. A system according to claim 24, wherein the respective further audio information is transmitted from the second or further source to the receiver by a mobile telephone connection.

31. A system according to claim 26, wherein the respective further audio information is transmitted from the second or further source respectively to the receiver by the cable or wire connection between the second or further source respectively and the receiver.

32. A system according to claim 28, wherein the respective further audio information is transmitted from the second or further source to the receiver by an Internet connection between the second or further source and the receiver.

33. A system according to claim 17 or 18, wherein the receiver comprises a key operable to initiate the transmission of the respective data signal dependent on the addressing data to the or another service provider respectively.

34. A system according to claim 33, wherein the receiver comprises a further key operable to cancel the receipt of the respective further audio information from the second or further source respectively at the receiver and to cause the receiver to convert the audio information from the first or second source respectively to an audio signal.

35. A method according to claim 2, wherein the first audio information together with other information comprising addressing data is transmitted from the first source to the receiver by a wire-less broadcast signal.

36. A method according to claim 35, wherein the broadcast signal is a digital audio broadcasting (DAB) signal.

37. A method according to claim 35, wherein the broadcast signal is a radio data service (RDS) signal.

38. A method according to claim 2, wherein the first audio information together with other information comprising addressing data is transmitted from the first source to the receiver by a cable or wire connection between the first source and the receiver.

39. A method according to claim 38, wherein the first audio information together with other information comprising addressing data is transmitted via an Internet connection.

40. A system according to claim 18, wherein the first audio information together with other information comprising addressing data is transmitted from the first source to the receiver by a wire-less broadcast signal.

41. A system according to claim 40, wherein the broadcast signal is a digital audio broadcasting (DAB) signal.

42. A system according to claim 40, wherein the broadcast signal is a radio data service (RDS) signal.

43. A system according to claim 18, wherein the first audio information together with other information comprising addressing data is transmitted from the first source to the receiver by a cable or wire connection between the first source and the receiver.

44. A system according to claim 43, wherein the first audio information together with other information comprising addressing data is transmitted via an Internet connection.

45. A system according to claim 30, wherein the a mobile telephone is a GSM or CDMA telephone.

46. A system according to claim 31, wherein the receiver includes a wire or cable-connected telephone.

* * * * *